US006119267A

United States Patent [19]

Pozzi

[11] Patent Number: 6,119,267

[45] Date of Patent: Sep. 19, 2000

[54] SLIP-ON HAND WRAP AND WRIST SUPPORT FOR BOXING AND MARTIAL ARTS

[76] Inventor: Chase Pozzi, 5700 Etiwanda Ave., Unit 156, Tarzana, Calif. 91356-2535

[21] Appl. No.: 09/249,670

[22] Filed: Feb. 12, 1999

Related U.S. Application Data

[60] Provisional application No. 60/084,178, May 4, 1998.

[51] Int. Cl.[7] ..... A41D 13/00; A61F 5/00

[52] U.S. Cl. ..... 2/20; 2/161.1; 2/917; 602/21; 602/22

[58] Field of Search ..... 2/161.1, 16, 17, 2/18–20, 159, 161.4, 161.2, 162, 163–164, 267, 167, 917; 482/44, 47, 48; 602/21, 22, 64; 128/877–880; 473/59, 61, 62

[56] References Cited

U.S. PATENT DOCUMENTS

| | | | |
|---|---|---|---|
| 3,728,738 | 4/1973 | Andolino . | |
| 4,183,100 | 1/1980 | De Marco . | |
| 4,977,621 | 12/1990 | Richard | 2/20 |
| 5,083,314 | 1/1992 | Andujar . | |
| 5,295,269 | 3/1994 | Ballard . | |
| 5,298,001 | 3/1994 | Goodson | 2/161.1 |
| 5,313,667 | 5/1994 | Levine . | |
| 5,335,916 | 8/1994 | Nee | 2/161.1 |
| 5,445,566 | 8/1995 | Hayes . | |
| 5,459,883 | 10/1995 | Garceau-Verbeck . | |
| 5,517,694 | 5/1996 | Fabry | 2/161.1 |
| 5,538,501 | 7/1996 | Caswell | 602/64 |
| 5,575,008 | 11/1996 | McBride et al. . | |
| 5,781,928 | 7/1998 | Avila . | |
| 5,898,944 | 5/1999 | Vrany | 2/161.4 |
| 5,933,868 | 8/1999 | Bender | 2/161.1 |

*Primary Examiner*—John J. Calvert
*Assistant Examiner*—Tejash Patel

[57] ABSTRACT

An anatomically designed slip-on wrist supporting hand wrap is provided which is able to replace the long cloth hand wrap used in boxing and the martial arts. The hand wrap includes a resilient wrap body having thumb and finger apertures, wrist support straps oppositely extending from the wrap body and wrist support strap fasteners, and a hand fastener removably attachable to the wrap body for adjustment to a desired fit. The hand wrap may include a knuckle pad, finger sleeves and a hand grip for added comfort and support. The user's fingers and thumb are inserted through the thumb and finger apertures, and the wrist support straps are wrapped about the hand and wrist and the fasteners secured resulting in a convenient yet supportive and protective hand wrap which can be used in conjunction with boxing and bag gloves.

18 Claims, 5 Drawing Sheets

FIG. 3
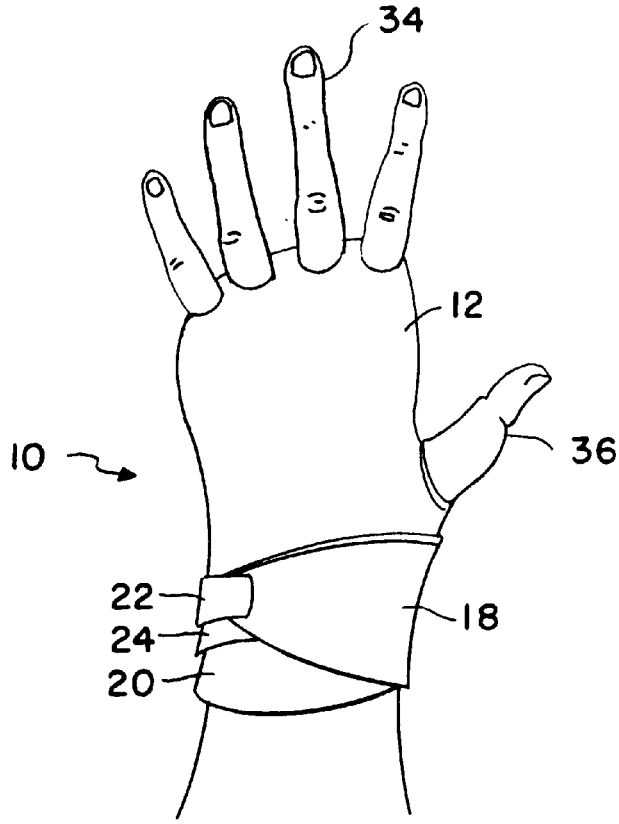
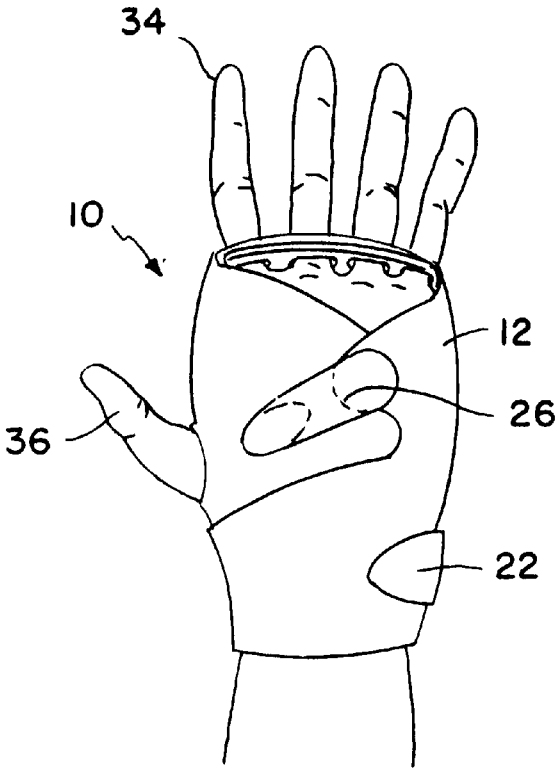
FIG. 4

SLIP-ON HAND WRAP AND WRIST SUPPORT FOR BOXING AND MARTIAL ARTS

RELATED APPLICATION

This application claims priority from Provisional Application Ser. No. 60/084,178, filed on May 4, 1998.

BACKGROUND OF THE INVENTION

This invention relates to hand and wrist protective wraps and supporters. More particularly, the present invention relates to a convenient, anatomically designed slip-on hand wrap and wrist support which replaces the long cloth hand wrap. The present invention is intended to prevent injury to the knuckle, hand, and wrist areas during boxing and martial arts related sports.

Participants involved in boxing and martial arts-related sports often wear hand and wrist protection under larger boxing or bag gloves for additional protection and support. This protection is commonly called a hand wrap. Traditional hand wraps are made of cotton or canvas material, and are several feet in length. The participant will tightly wrap this material around his or her knuckles, hands, and wrists. The traditional hand wrap is designed, if applied properly, to protect the knuckles, hands, and wrists from serious injury potentially resulting from impact blows to hard objects. These hand wraps can effectively prevent serious injury to hands during full contact professional or amateur fighting if they are administered and used correctly.

However, the traditional long cloth wrap suffers many drawbacks, particularly for the amateur or recreational user. As the long cloth wrap is typically worn underneath a glove, it becomes filthy and discolored almost immediately when used. Thus, the long cloth wrap requires frequent cleaning. The long cloth wrap will not maintain its shape and manageability unless it is tightly rolled when not in use. Moreover, if the traditional hand wrap is not wrapped about the hand and wrist properly, it will easily become loose and unravel. This loosening lessens, and may even eliminate, the protection to the hands and wrists.

Applying the long cloth hand wrap is a lengthy process which is cumbersome and time consuming by its nature. Preferably, the long cloth wrap is wrapped between one's fingers maintaining the fingers at an evenly spaced position. The wrap acts to prevent the knuckles from becoming distorted or smashed and acts as a shock absorber on inconsistent or uneven hits. Without adequate finger and knuckle protection, the base of the fingers become bruised and swollen, even after a light exercise, potentially resulting in future problems such as arthritis.

With the ever growing popularity of aerobic and recreational styles of boxing and martial arts enjoyed by people of all walks of life, the traditional long cloth hand wrap has been found by these users to be excessively cumbersome, inconvenient and time consuming. The long cloth wrap may also give inadequate protection to the average recreational or amateur user as, unlike the professional boxer or martial artist, the average consumer will typically wrap the long cloth around the hand and knuckles, leaving the fingers and the soft tissue between the joints of the fingers unprotected. The amateur or recreational user may also not correctly wrap the wrist, leaving the wrist prone to injury from torsional forces applied to the wrist at a variety of angles.

Some consumers, not wanting to cope with the traditional long cloth hand wrap, resort to wearing makeshift alternatives under their boxing or bag gloves such as weight lifting gloves, knuckle pads, or equipment adapted from incompatible sports. These forms of intended protection suffer a number of disadvantages. Other forms of hand protection such as knuckle pads, or glove-like devices adapted from dissimilar sports, do not have the anatomically form-fitting qualities to the knuckle, hand, and wrist areas that the traditional hand wrap was designed to protect. Nor does the design of these incompatible protection devices coincide with the consumer's ability to insert them into other gloves, such as boxing or bag gloves.

Many traditional hand wraps, knuckle pads, and glove-like devices adapted from dissimilar sports that are presently used do not embody a wrist support strap, or include only a single strap that is wrapped around the wrist from only one direction, providing limited support. As the wrist moves in many directions, these versions leave the wrist open to injuries such as sprains from compression and over extending or hyperextending the wrist in different directions.

Thus what is needed is a hand wrap better suited for the consumer involved in combative and recreational forms of boxing and martial arts which is more convenient and easy to use than the traditional long cloth hand wrap. What is also needed is a hand wrap which is contoured, cushioned protected, and comfortable for all types of consumers. What is further needed is a hand wrap which is designed for convenience and support, being able to be easily slipped on for rapid employment, fastened easily and securely, unable to loosen on its own and drawn and tightened to one's own measure of support. Additionally, a hand wrap is needed which will not become unsightly, even after extended periods of use, may be easily cleaned and will consistently maintain its shape and form. Moreover, a hand wrap is needed that is anatomically designed specifically for the demanding activities of boxing and martial arts providing effective protection to the wrist, hand, and knuckle areas. The present invention fulfills these needs and provides other related advantages.

SUMMARY OF THE INVENTION

The present invention resides in a hand and wrist support wrap which is anatomically designed to conveniently slip-on the hand and wrap around the wrist. The hand wrap is comprised, generally, of a wrap body having thumb and finger apertures, first and second wrist support straps and fasteners removably attachable to a portion of the wrap body for securing and adjusting the fit of the hand wrap.

In a first illustrated embodiment, the wrap body is comprised of a resilient material having an irregular shape and generally uniform thickness. The wrap body includes a thumb aperture and a plurality of, finger apertures which are substantially aligned and adjacent to one another near an edge of the wrap body. The finger and thumb apertures may be circular or non-circular depending on the preference of the user.

Attached to the wrap body are first and second wrist straps which extend from the wrap body at angles somewhat opposed to one another. The wrist straps may be formed integrally with the wrap body. Each strap has a fastener which is fixed to a distal end of the strap and removably attachable to another portion of the hand wrap. A third fastener, in the form of a hand fastener, is also attached to and extends from the wrap body. The hand fastener may be attached to a hand strap which extends from the wrap body. The hand fastener may also be removably attachable to a portion of the wrap body. The fasteners may be in the form of many commercially available fasteners, but are preferably hook and loop tape fasteners.

A second illustrated embodiment utilizes the structural elements of the first embodiment, and includes a knuckle pad which is attached to the wrap body near the finger apertures. The knuckle pad may include finger apertures which axially align with the finger apertures of the wrap body, allowing fingers to extend through the finger apertures of both the knuckle pad and the wrap body. Finger sleeves may protrude from the knuckle pad or from the main body through the finger apertures of the wrap body. The finger sleeves typically cover a lower third portion of the user's fingers and act to protect the fingers from injury.

In a third illustrated embodiment, in addition to the knuckle pad and partial finger sleeves, a hand grip extends from the knuckle pad beyond the edge of the wrap body. The finger sleeves may have flanges which act to hold the knuckle pad to the wrap body and further provide protection to the fingers and joints. The partial finger sleeves are typically comprised of a cushioned resilient material similar in composition to the wrap body or knuckle pad.

In use, the fingers and thumb are inserted through the thumb and finger apertures of the wrap body. The wrist support straps are wrapped around the bottom and over the top of the wrist in opposing directions to a desired tightness. The wrist fasteners are fastened in place. The hand fastener is pulled across the palm of the hand to a desired tightness and fastened to a portion of the wrap body. This results in a hand and wrist supporting strap which protects the fingers, hand, and wrist from injury when hitting objects.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a front elevational view of a slip-on hand wrap of FIG. 1, shown completely wrapped and fastened to the user's hand and wrist;

FIG. 4 is a rear elevational view of the wrapped hand wrap of FIG. 3;

DETAILED DESCRIPTION OF THE PREFERRED EMBODIMENTS

Figure 1:
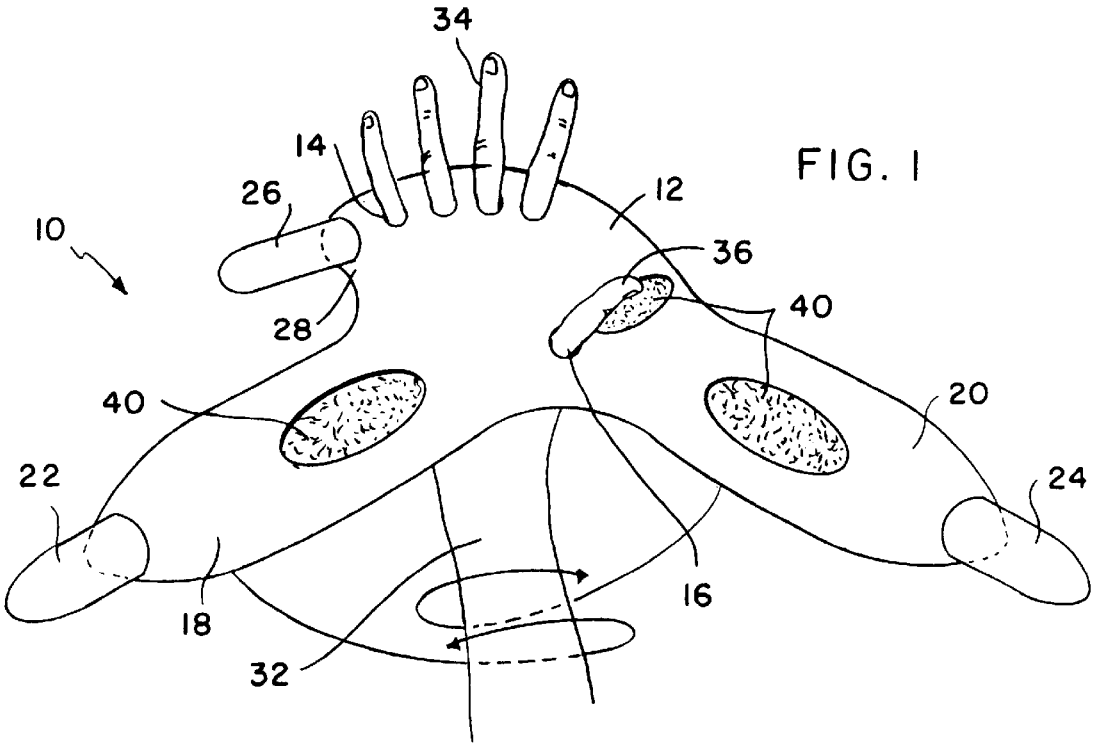
FIG. 1 illustrates a front elevational view of a slip-on hand wrap embodying the present invention, with the fingers and thumb of a user inserted through corresponding finger and thumb apertures.

As shown in the drawings for purposes of illustration, the present invention is concerned with a slip-on hand wrap, generally referred to by the reference numeral 10, which replaces the traditional long cloth wrap.

As illustrated in FIGS. 1–4, the hand wrap 10 generally comprises of an irregular anatomically shaped wrap body 12 having finger apertures 14 and a thumb aperture 16 therethrough. A first wrist support strap 18 and a second wrist support strap 20 are attached to the wrap body 12 and extend therefrom in opposite directions. The wrist support straps 18 and 20 may be attached to or integrally formed with the wrap body 12, and each include a corresponding first or second wrist strap fastener 22 and 24, respectively, which is removably attachable to the wrap body 12. A third fastener 26, which acts as a hand fastener, is also attached to or integrally formed with the wrap body 12. The third fastener 26 may also be attached to a hand strap 28 which is integrally formed with the wrap body 12.

The wrap body 12 is comprised of any resilient material that can be repeatedly stretched, is somewhat soft and will supply support and padding around joints. Preferably, a flexible rubber such as neoprene is used although other rubbers, foam, leather, nylon, vinyl, lycra, polyester, encapsulated gel, cotton, canvas and synthetic materials can also be used. For added comfort or strength, the resilient material of the wrap body 12 may be laminated to other materials. Materials which are comfortable to the human skin, wick away moisture, and better withstand external forces may be laminated or otherwise attached to the wrap body 12.

Figure 5:
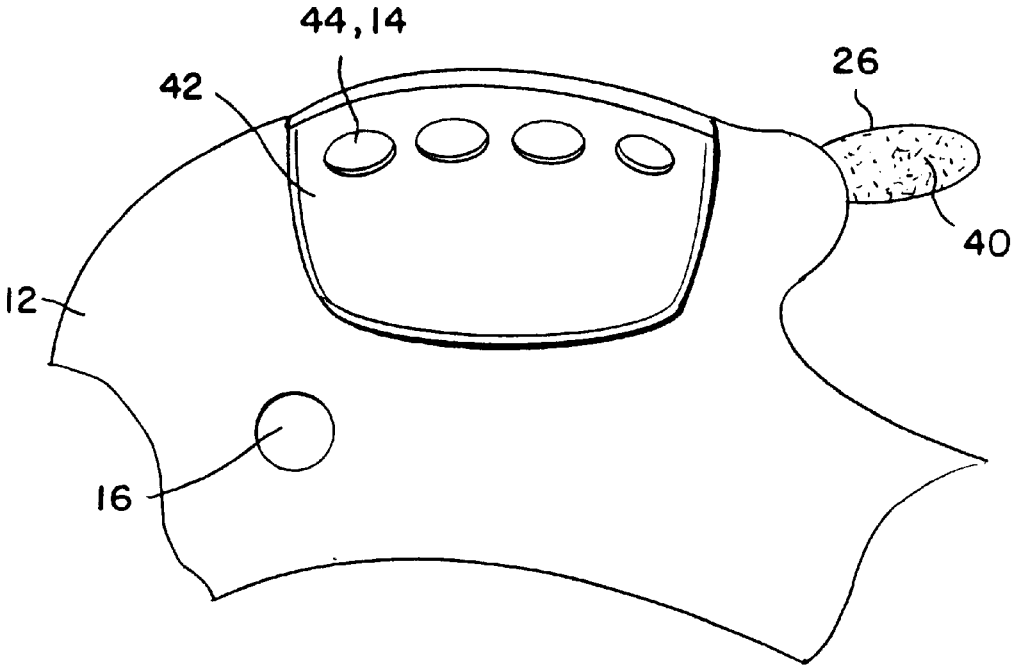
FIG. 5 is a fragmented rear elevational view of the hand wrap of FIG. 1, illustrating the attachment of a knuckle pad having finger apertures fixed to a wrap body and aligned with the wrap body finger apertures.
Figure 6:
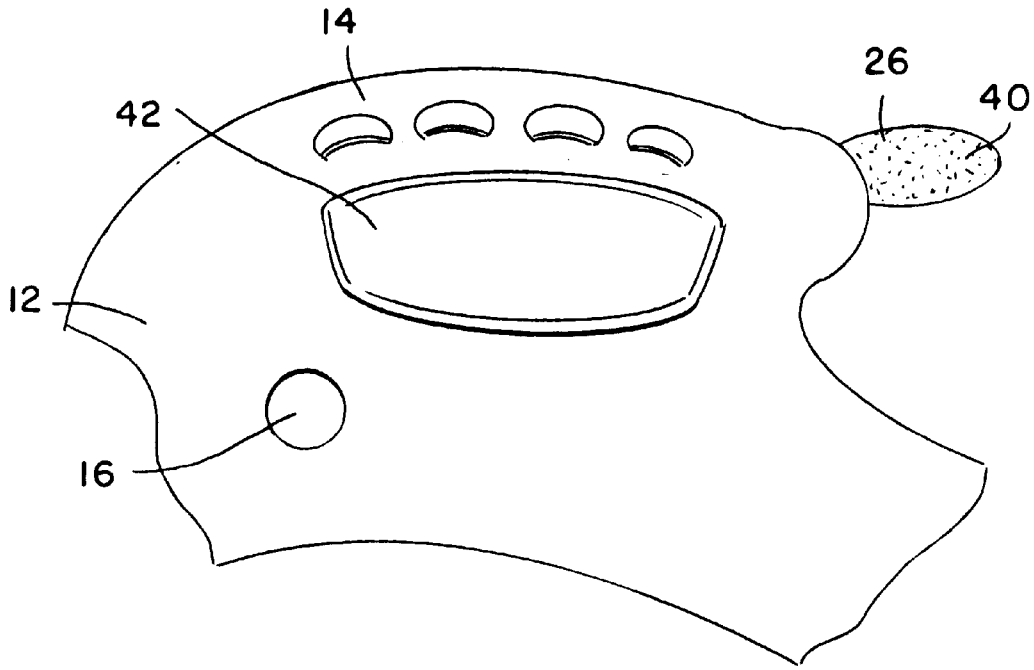
FIG. 6 is a fragmented rear elevational view of a hand wrap similar to FIG. 5, illustrating another type of knuckle pad attached to the wrap body near the finger apertures.

The wrap body 12 is designed specifically to anatomically conform to a human hand 30 and wrist 32. The wrap body 12 includes a plurality of finger apertures 14 which are substantially aligned and adjacent to one another. Preferably, the wrap body 12 has four finger apertures 14. The finger apertures 14 can be of various shapes and dimensions including, but not limited to, circular, elliptical and moon-shaped as illustrated in FIGS. 5 and 6. The finger apertures 14 can also be of varying diameters to fit a variety of fingers 34. For example, a smaller hand wrap 10 may have finger apertures 14 with smaller diameters than those of a larger hand wrap 10. Furthermore, the finger aperture 14 intended for the pinky may be smaller than the other apertures 14. Due to the nature of the resilient deformable material of the wrap body 12, a one-size fits all finger aperture 14 is also possible. Preferably, finger apertures 14 are slightly smaller than the width of the finger 34 so that the wrap body 12 will stretch around the fingers 34, giving a tight fit when worn.

The thumb hole 16 is also formed through the wrap body 12, and so spaced from the index finger aperture 14 so as to be anatomically consistent with and more naturally fit the hand 30. The thumb aperture 16, like the finger apertures 14, can be made in a variety of sizes. Usually the thumb aperture 16 is just smaller in diameter than a thumb 36 so that the wrap body 12 stretches around and fits tightly about the thumb 36. Both the thumb aperture 16 and the finger apertures 14 can be made by a variety of manufacturing processes including, but not limited to, drilling, punching, cutting and molding.

Figure 2:
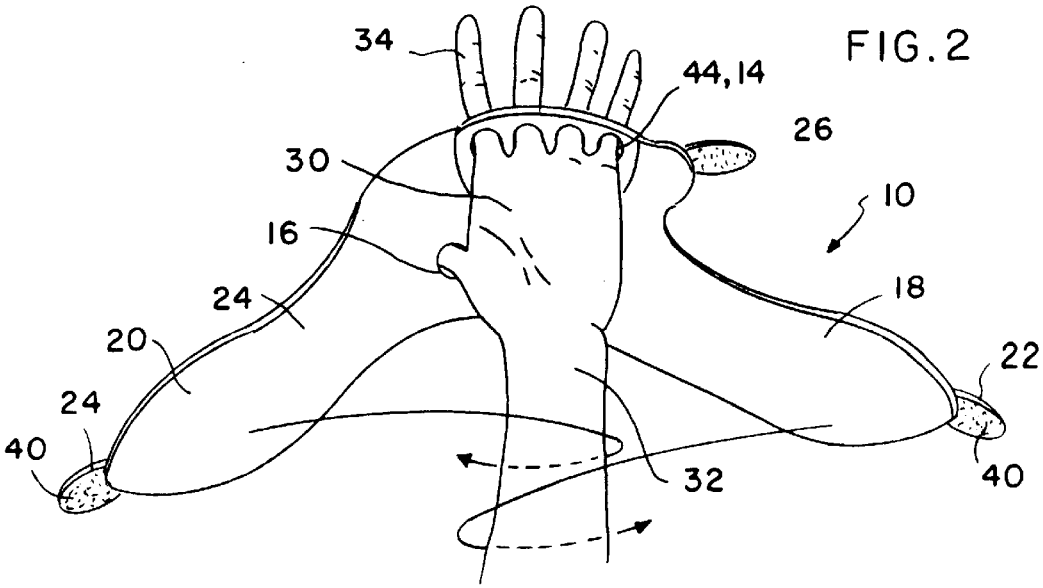
FIG. 2 is a rear elevational view of FIG. 1.

Each wrist support strap 18 and 20 has a corresponding fastener 22 and 24 fixed substantially near a distal end 38 of the wrist strap 18 and 20. The wrist support strap fasteners 22 and 24 and the hand fastener 26 are preferably comprised of hook and loop tape 40 (as shown in FIGS. 1 and 2), but may comprise a buckle, snaps, strap, or any other form of fastening which will tightly hold the wrist support straps 18 and 20 in place. The fasteners 22, 24 and 26 may be comprised of the same material as the wrap body 12, but may also be comprised of any other material which provides support to the hand 30 and wrist 32 while being flexible and durable. The wrist support straps 18 and 20 are anatomically designed to fit around and provide support for the hand 30 and wrist 32 from many directions.

Referring now to FIG. 6, another form of the present invention uses the above described structural features as well as a knuckle pad 42 attached to the wrap body 12 adjacent to the finger apertures 14. The knuckle pad 42 may be comprised of the same material as the wrap body 12, or any other material which can be repeatedly stretched while providing support and padding around the knuckle joints. The knuckle pad 42 may be rectangular in shape and generally has rounded corners for comfort. The knuckle pad 42 may be attached to the wrap body 12 by any adequate means including, but not limited to, sewing, adhesion or lamination. As illustrated in FIG. 5, the knuckle pad 42 may include finger apertures 44 which are substantially the same size and aligned with the finger apertures 14 of the wrap body 12.

Figure 7:
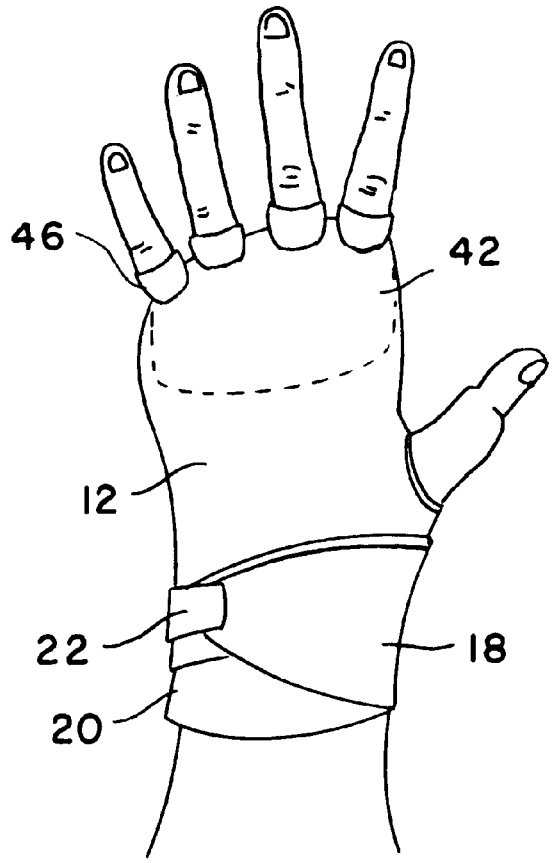
FIG. 7 is an elevational view of a hand and wrist completely wrapped in a slip-on hand wrap similar to those shown in FIGS. 1–6, but further providing finger sleeves extending from the knuckle pad or from the main body through the finger apertures.
Figure 8:
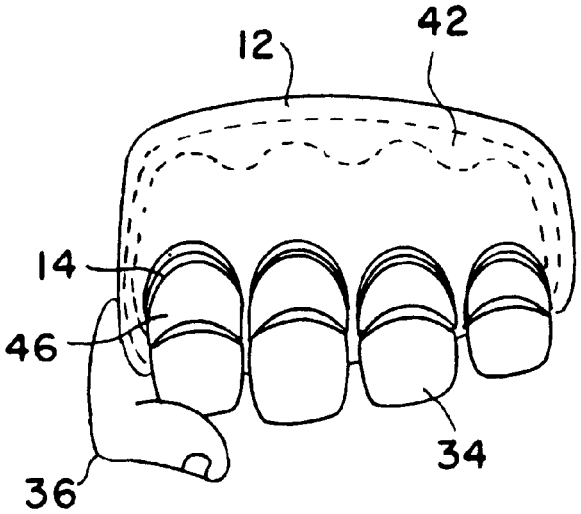
FIG. 8 is an elevational view of a fist wrapped in the hand wrap of FIG. 7, illustrating the finger sleeves covering the lower one-third of the fingers of the user.

As illustrated in FIGS. 7 and 8, the knuckle pad 42 may include finger sleeves 46 which protrude from the knuckle pad 42 and extend through the finger apertures 14 of the wrap body 12. The finger sleeves 46 may be comprised of the same material as the knuckle pad 42. Alternatively, the finger sleeves 46 may be part of or attached to the wrap body 12. The finger sleeves 46 envelope approximately one-third of the user's lower fingers 34, giving the user's fingers 34 more support and protection from bruising and swelling between the finger joints.

Figure 9:
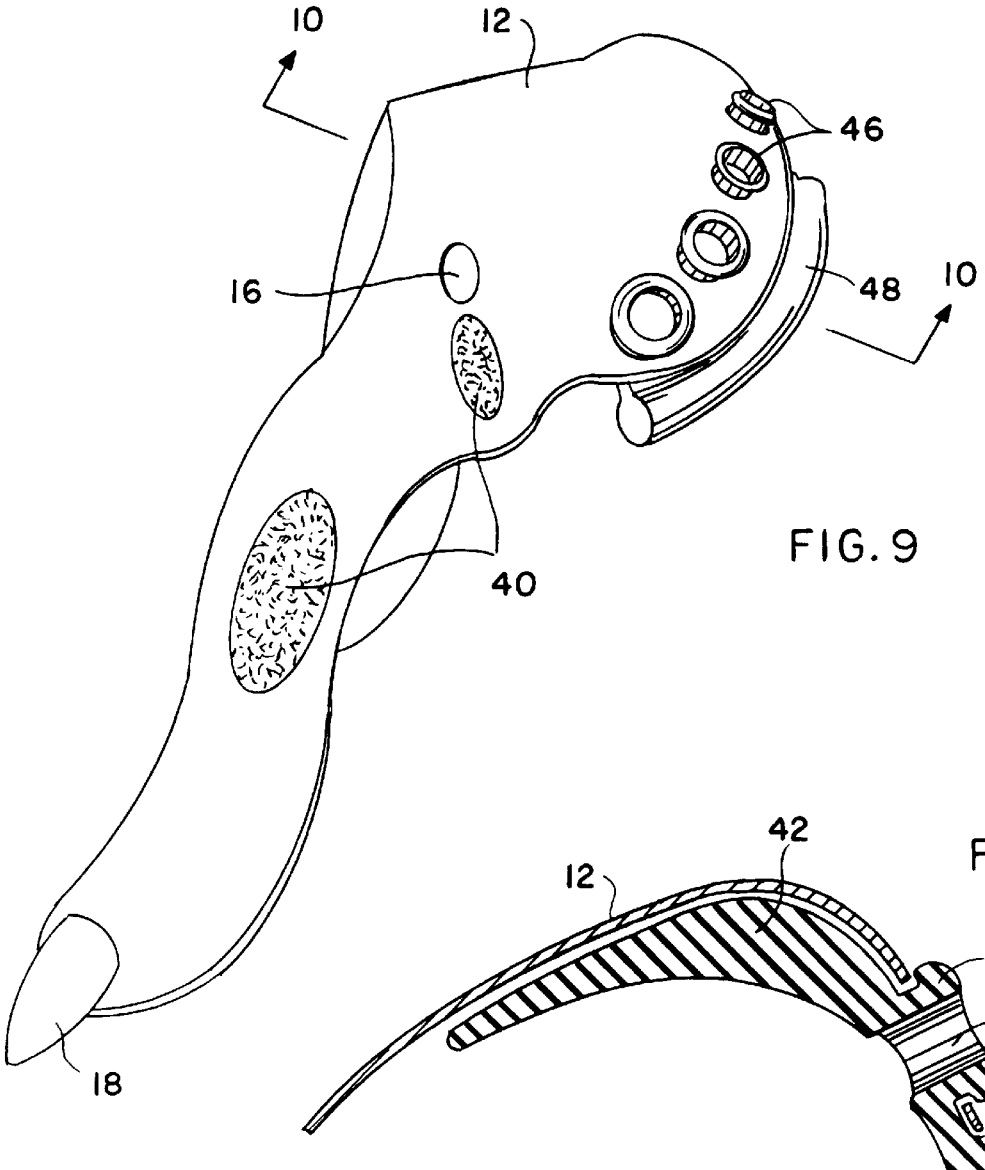
FIG. 9 is a side elevational view of a hand wrap having modified finger sleeves and a hand grip.
Figure 10:
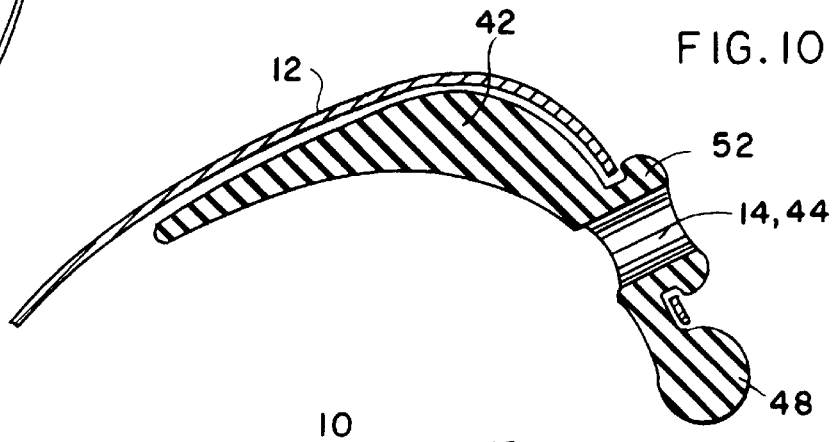
FIG. 10 is a cross-sectional view taken along the line 10—10 of FIG. 9, illustrating a finger sleeve protruding from the knuckle pad and extending through a finger aperture, wherein the hand grip is integrally formed with the knuckle pad and extends beyond an edge of the wrap body.
Figure 11:
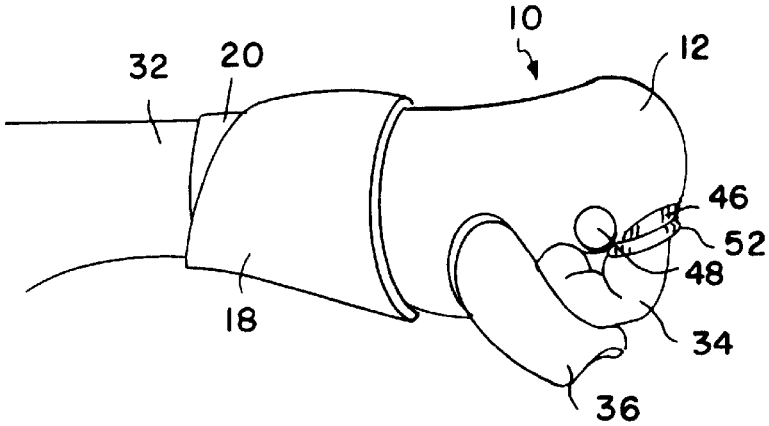
FIG. 11 is a side elevational view of a wrist and clinched fist wrapped with the hand wrap of FIGS. 9 and 10, illustrating the finger sleeves covering the lower portion of the fingers and the hand grip clenched in the user's fist.

In FIGS. 9–11, yet another form of the invention is illustrated which includes a hand grip 48 which is attached to the knuckle pad 42 and extends beyond an edge 50 of the wrap body. The hand grip 48 may be integrally formed with the knuckle pad 42 and comprised of the same material as the knuckle pad 42. The hand grip 48 gives additional support and protection to the user when the user clinches his or her fist around the hand grip 48. The finger sleeves 46 may have flanged ends 52 which give additional protection to the fingers 34 of the user. The flanged ends 52 also allow the knuckle pad 42 to be removably attached to the wrap body 12. This is accomplished by forcibly inserting the flanged ends 52 of the finger sleeves 46 through the finger apertures 14; as the flanged ends 52 are larger than the finger apertures 14, the knuckle pad 42 is held in place. In this manner, the knuckle pad 42 can be removed and cleaned separately from the wrap body 12, or even replaced if necessary.

While achieving the results of a properly wrapped long cloth wrap, the manner of using the hand wrap 10 is significantly different than that of the long cloth wrap. The user first inserts his or her fingers 34 and thumb 36 through the finger apertures 14, 44 and thumb aperture 16 while pulling the wrap body 12 tightly toward the base of each finger 34 and thumb 36 (as illustrated in FIG. 2). The knuckle pad 42 should be positioned over the knuckles at this point. The wrist strap 18 is then pulled and tightly wrapped below and then over the wrist 32, as shown by the directional arrows in FIGS. 1 and 2. The corresponding wrist support strap fastener 22 is then fastened to the wrap body 12 (as illustrated in FIG. 3). The same process in the opposite direction is taken to secure the second wrist strap 20. The hand fastener 26 is pulled across palm of the hand 30 and fastened to the wrap body 12, as illustrated in FIG. 4.

After slipping the hand wrap on the hand and wrist and adjusting it to a desired tightness as described above, the user may clench the hand grip 48 (if provided) when making a fist for added support and protection to the fingers 34 and hand 30. This results in a slip-on hand wrap 10 which supports and protects the hand 30, wrist 32 and fingers 34 while being very simple and convenient to use.

There are many advantages to using the present invention. Since the user can self-adjust the hand wrap 10 for desired tightness and support, the hand wrap 10 may be manufactured as a one-size fits all article. With relatively few changes, the hand wrap 10 can be modified to more specifically fit small, medium and large sized hands 30 and fingers 34. Due to the fact that there are few parts, the hand wrap 10 can be made inexpensively. In fact, much of the wrap 10 can be made from a single piece of material. The hand wrap 10 also lends itself to being produced in various colors to satisfy the aesthetic demands of the consumer.

Perhaps more importantly, the wrap 10 is designed to prevent injuries such as bruising, inflammation, and hyperextension to the knuckle, hand 30 and wrist 32 caused by the shock of repetitive hits. This is accomplished through the use of the resilient materials used in the wrap body 12 and knuckle pad 42, as well as the adjustability of the wrist support straps 18. The hand wrap 10 is anatomically designed to give adequate spacing, and padding, around and between the base of each finger 34, and completely surround each knuckle, to prevent long lasting injuries to those areas. The hand wrap 10 is also designed to absorb the shock to the soft tissue between each knuckle when the wearer strikes an object unevenly as occurs when the front of the fist is not flush with the surface plane being struck. The hand wrap 10 also provides a dual wrist support system, with each of the two support wrist straps 18 designed to be drawn and wrapped from opposite directions, giving the wrist 32 complete support and protection from the long lasting injuries due to hyperextension.

Unlike the long cloth wrap, the hand wrap 10 will not unravel. This is advantageous to both the skilled and unskilled user. The one-piece, slip-on nature of the hand wrap 10 particularly lends itself to the unskilled who may not be willing, or even know, how to correctly wrap their hands 30 and wrists 32 using the traditional long cloth wrap, but can easily and conveniently use the hand wrap 10 of the present invention.

Although the description set forth above describes in detail several embodiments of the invention for purposes of illustration, various modifications may be made without departing from the spirit and scope of the invention. Accordingly, the invention is not to be limited, except as by the appended claims.

What is claimed is:

1. A slip-on hand wrap, comprising:

a wrap planar body having a plurality of finger apertures and a thumb aperture in the planar;

first and second wrist support straps oppositely extending from the wrap body such that when fingers are inserted through the finger apertures, the wrist support straps wrap around a user's wrist in opposite directions;

first and second fasteners fixed to distal ends of the respective first and second wrist support straps, and removably attachable to another portion of the hand wrap; and a third fastener fixed to the wrap body adjacent to the plurality of finger apertures and opposite the thumb aperture, and removably attachable to another portion of the hand wrap.

2. The hand wrap of claim 1, wherein the wrap body is comprised of a resilient material.

3. The hand wrap of claim 1, including a hand strap integrally formed with the wrap body and to which the third fastener is fixed.

4. The hand wrap of claim 3, wherein the wrist straps are integrally formed with the wrap body.

5. The hand wrap of claim 1, wherein the wrap body includes four finger apertures substantially aligned and adjacent to one another.

6. The hand wrap of claim 5, wherein the finger apertures are non-circular.

7. The hand wrap of claim 1, wherein the fasteners include hook and loop tape fasteners.

8. The hand wrap of claim 1, wherein a knuckle pad is attached to the wrap body adjacent to the finger apertures.

9. The hand wrap of claim 8, wherein the knuckle pad has finger apertures aligned with the wrap body finger apertures.

10. The hand wrap of claim 9, wherein the knuckle pad includes finger sleeves which extend through the finger apertures of the wrap body.

11. The hand wrap of claim 10, wherein the knuckle pad includes a hand grip extending beyond an edge of the wrap body.

12. The hand wrap of claim 10, wherein the knuckle pad is attached to the wrap body by means of the finger sleeves extending through the finger apertures of the wrap body.

13. A slip-on hand wrap, comprising:

a resilient wrap body having a plurality of finger apertures and a thumb aperture;

a knuckle pad attached to the wrap body adjacent to the finger apertures;

first and second wrist support straps integrally formed with the wrap body and oppositely extending therefrom such that when fingers are inserted through the finger apertures, the wrist support straps wrap around a user's wrist in opposite directions;

first and second fasteners fixed to distal ends of the respective first and second wrist support straps, and removably attachable to another portion of the hand wrap; and a third fastener fixed to the wrap body adjacent to the finger apertures and opposite the thumb aperture, and removably attachable to another portion of the hand wrap.

14. The hand wrap of claim 13, including a hand strap integrally formed with the wrap body and to which the third fastener is fixed.

15. The hand wrap of claim 13, wherein the fasteners include hook and loop tape fasteners.

16. The hand wrap of claim 13, wherein the knuckle pad includes finger apertures which are aligned with the finger apertures of the wrap body.

17. The hand wrap of claim 16, wherein the knuckle pad includes finger sleeves which extend through the finger apertures of the wrap body.

18. A slip-on hand wrap, comprising:

a resilient wrap body having four finger apertures and a thumb aperture;

a knuckle pad attached to the wrap body, including finger apertures aligned with the finger apertures of the wrap body, and finger sleeves protruding from the knuckle pad through the finger apertures of the wrap body;

first and second wrist support straps integrally formed with the wrap body and oppositely extending therefrom such that when fingers are inserted through the finger apertures, the wrist support straps wrap around a user's wrist in opposite directions;

first and second fasteners fixed to distal ends of the respective first and second wrist support straps, and removably attachable to another portion of the hand wrap;

a hand strap integrally formed with the wrap body adjacent to the finger apertures and opposite the thumb aperture; and a third fastener fixed to the hand strap and removably attachable to another portion of the hand wrap.

* * * * *